United States Patent [19]

Wollman

[11] 4,454,183

[45] Jun. 12, 1984

[54] STRIP MATERIAL WITH HEAT-FORMED HOOKED HEADS

[75] Inventor: Sandford L. Wollman, St. Paul, Minn.

[73] Assignee: Minnesota Mining and Manufacturing Company, St. Paul, Minn.

[21] Appl. No.: 543,786

[22] Filed: Oct. 20, 1983

Related U.S. Application Data

[63] Continuation of Ser. No. 352,850, Feb. 26, 1982, abandoned.

[51] Int. Cl.[3] ..... A44B 17/00

[52] U.S. Cl. ..... 428/92; 428/93; 428/100; 428/120; 428/95; 24/306

[58] Field of Search ..... 428/100, 99, 92, 119, 428/120, 397, 196, 197, 93, 95; 24/204

[56] References Cited

U.S. PATENT DOCUMENTS

| | | | |
|---|---|---|---|
| 3,009,235 | 11/1961 | Mestral | 28/78 |
| 3,138,841 | 6/1964 | Naimer | 24/204 |
| 3,527,001 | 9/1970 | Kleemeier et al. | 51/358 |
| 3,577,607 | 5/1971 | Ikoma | 24/204 |
| 3,708,833 | 1/1973 | Ribich | 24/204 |
| 3,708,837 | 1/1973 | Chiba | 24/204 |
| 3,770,359 | 11/1973 | Hamano | 425/305 |
| 4,024,003 | 5/1977 | Buhler | 156/148 |
| 4,290,832 | 9/1981 | Kalleberg | 156/72 |

OTHER PUBLICATIONS

Plastics World, "Continuous Molding", pp. 64–67, 12/80.

*Primary Examiner*—Alexander Thomas

*Attorney, Agent, or Firm*—Donald M. Sell; James A. Smith; William L. Huebsch

[57] ABSTRACT

In an elongate strip material which can be severed into lengths to form at least a part of a fastener. The strip material comprises a backing and a multiplicity of lengths of polymeric monofilament having cross sections defining a plurality of radially projecting lobes, each length including a central bight portion secured in the backing, and two stem portions extending from opposite ends of the bight portion and projecting away from the backing. Enlarged heads are formed by heat at the ends of the stem portions opposite the backings, and the heads include hook-like portions spaced from the stem portions and projecting along the stem portions toward the backing that result from heating the ends of the monofilaments because of their lobed cross sections.

4 Claims, 9 Drawing Figures

STRIP MATERIAL WITH HEAT-FORMED HOOKED HEADS

This is a continuation of application Ser. No. 352,850 filed Feb. 26, 1982 abandoned.

TECHNICAL FIELD

This invention relates to strip materials that can be severed into lengths to form at least parts of fasteners, and in particular to such strip materials that include projecting headed monofilaments.

BACKGROUND ART

Strip materials that can be severed into lengths to form at least parts of fasteners are well known, typical examples being those described in U.S. Pat. Nos. 3,009,235; 3,138,841; 3,577,607; 3,708,837; 3,770,359; 4,024,003; and 4,290,832.

Several of these patents describe strip materials including a backing which can be woven or comprise a nonfibrous polymeric layer and a multiplicity of lengths of longitudinally oriented flexible resilient polymeric monofilament, each of which lengths includes a central bight portion secured in the backing by weaving, fusing or both, two stem portions extending from the opposite ends of the bight portion which project generally normal to a major surface of the backing, and enlarged heads at the ends of the stem portions opposite the backing formed by heating those ends.

It is well known in the fastener art that the heads of such strip material will releasably engage with loops projecting from a backing (called loop material herein). The heads of such strip material will be strongly held by the loops of such loop material when an attempt is made to separate the strip and loop materials by moving their backings in a direction parallel to each other because the loops can then engage around the stem portions under the heads. The loops will hold the heads with much less strength when an attempt is made to move the backings of the strip and loop materials away from each other in a direction generally normal to the major surface of the strip material, however, since the heads have surfaces adjacent the backing which are generally planar and extend at generally a right angle radially from their supporting stem portions so that the loops cannot firmly engage those head surfaces. Thus to provide fastener portions that the loops can firmly engage under such conditions (such as may be desirable to fasten a seat cover fabric lined with loop material to a molded seat cushion), manufacturers have resorted to molding lengths of strip material that include a backing, a plurality of stems projecting normally from a major surface of the backing, and heads on the ends of the stems opposite the backing, each of which heads has two hook-like portions spaced from its supporting stem and projecting along the stem toward the backing (e.g., "Molded Velcro Arrowhead #8 Tape" available from Velcro Industries Limited, New York, N.Y.). Such hooks can be firmly engaged by the loops when the backings are moved away from each other in a direction generally normal to the major surface of the strip material, but molded strip material is not without its disadvantages. For example, the strength and flexibility of a molded stem is less than the strength and flexibility of a similar sized stem made from a longitudinally oriented monofilament; only two hooks can easily be molded on each head and those hooks on each head must be oriented in the same direction relative to the backing which might limit the ability of the loops of some loop materials to engage the hooks; it is difficult to make molded strip material with closely spaced stems, or to vary the spacing between stems to change the holding ability of the molded strip material; and the backing layer is rather stiff for some applications where flexibility is desirable.

DISCLOSURE OF THE INVENTION

The present invention provides a strip material which can be severed into lengths to form at least a part of a fastener, which strip material (1) includes stems made from extruded monofilaments projecting from a backing that have heads including hooks projecting from the heads toward the backing that can be firmly engaged by loops projecting from a loop material; (2) is formed utilizing known manufacturing techniques that are more versatile than molding, and (3) can easily be formed with more than two hooks on each head to facilitate firm engagement of the loops with the heads.

The present invention comprises making strip material using longitudinally oriented polymeric monofilaments that have a cross section defining a plurality of radially projecting lobes, and heating the ends of the monofilaments to form the heads whereupon, suprisingly, each of the lobes forms a hook-like portion on the head which is spaced from the stem portion supporting the head and projects a distance along that stem portion toward the backing.

Preferably the monofilaments are of polypropylene that is extruded through an appropriately shaped die to form the radially projecting lobes. Two, three, four or more lobes may be provided, but preferably the monofilament should have three lobes. Trilobal monofilament forms three hook-like projections spaced around the head to provide more engagement possibilities by loops into which the head is thrust than would two hook-like portions; and yet provides clean separation between the hook-like portions so that the loops can securely engage the hook-like portions, which separation is decreased for the same sized monofilament if more hook-like portions are formed.

Fasteners using the novel monofilament and head structure described above can be made generally in accordance with the description in U.S. Pat. No. 3,770,359 using a weaving machine such as a needle loom or a shuttle loom, or can be made by with other similar weaving methods such as the methods described in U.S. Pat. Nos. 3,138,841 and 4,024,003 to provide a flexible woven backing; or can be made utilizing the method described in U.S. Pat. No. 4,290,832, which method affords greater versatility in the density and spacing of headed stem portions provided on the strip material and provides a relatively inexpensive but relatively stiff nonfibrous polymeric backing. The contents of U.S. Pat. Nos. 3,138,841; 3,770,359; 4,024,003; and 4,290,832, which describe these methods are incorporated herein by reference.

BRIEF DESCRIPTION OF DRAWING

The present invention will be more thoroughly described with reference to the accompanying drawing wherein like numbers refer to like parts in the several views and wherein.

DETAILED DESCRIPTION

Figure 1:
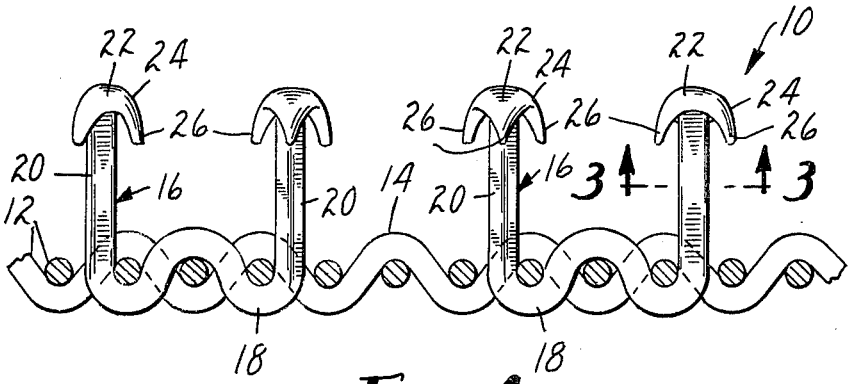
FIG. 1 is an enlarged fragmentary sectional view of one embodiment of the strip material according to the present invention.
Figure 2:
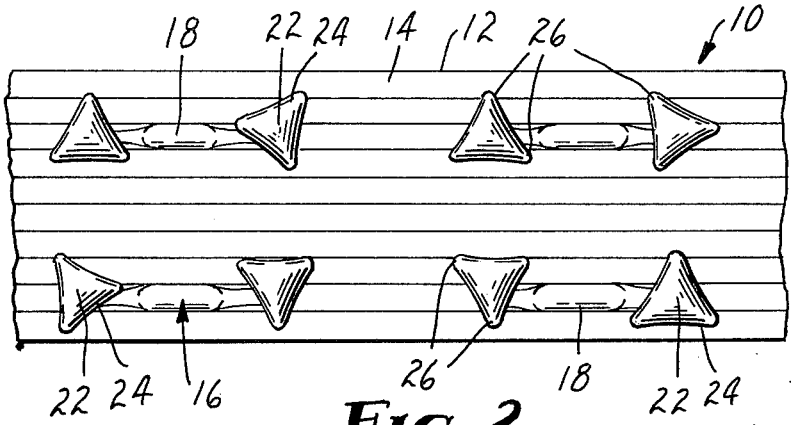
FIG. 2 is a top view of the strip material shown in FIG. 1.
Figure 4:
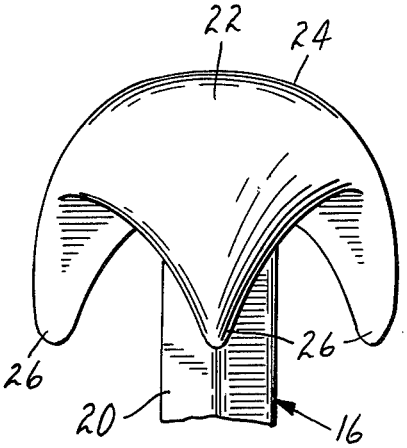
FIG. 4 is an enlarged fragmentary view of a head included in the strip material of FIG. 1.

Referring now to the drawing, there is illustrated in FIGS. 1 through 5 a first embodiment of an elongate strip material according to the present invention, generally designated by the reference numeral 10.

Figure 3:
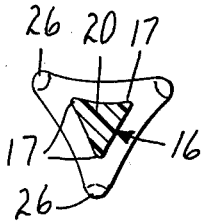
FIG. 3 is a sectional view taken approximately along lines 3—3 of FIG. 1.

Generally the strip material 10 (which can be formed generally in accordance with the method described in U.S. Pat. No. 3,770,359) comprises a flexible woven backing 12 having an exposed major surface 14, and a multiplicity of flexible resilient lengths of longitudinally oriented polymeric monofilament 16 having a generally equilateral triangular cross section defining three equally spaced projecting lobes 17 (FIG. 3). Each length of monofilament 16 includes a central bight portion 18 secured in the backing 12 by being woven therein, two stem portions 20 extending from the opposite ends of the bight portion 18 projecting generally normal to the exposed major surface 14 of the backing 12, and an enlarged head 22 at the end of each stem portion 20 opposite the backing 12. Each of the heads 22 is formed by heating the end of the trilobal monofilament 16 and has a shape resulting from such heating including a generally semi-spherical cam surface 24 opposite its supporting stem portion 20 and three hook-like portions 26 spaced from the stem portions 20 and projecting a distance along the stem portion toward the backing 12.

Figure 5:
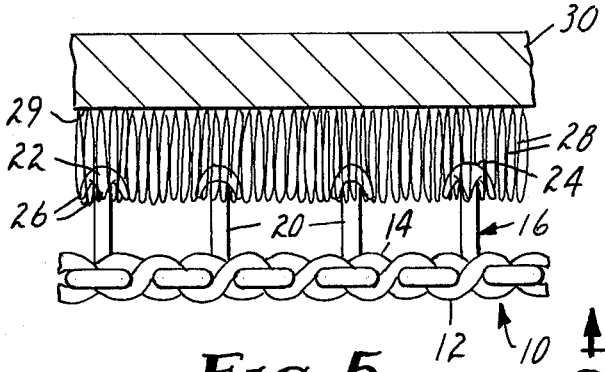
FIG. 5 is a reduced fragmentary sectional view of the strip material of FIG. 1 shown engaged with loops of a loop material.

As is illustrated in FIG. 5, these hook-like portions 26 can be securely engaged by loops 28 projecting from a surface 29 of a loop material 30 (which loop material 30 may be another part of a fastener comprising the loop material 30 and a length of the strip material 10; or may be a backing layer on a finishing material such as automobile upholstery or headliner) such engagement will be quite strong even if the strip material 10 and the loop material 30 are moved away from each other in a direction generally normal to their facing surfaces 14 and 29 since loops engaged behind the hook-like portions 26 of the heads 22 must typically be broken for separation to occur.

Figure 6:
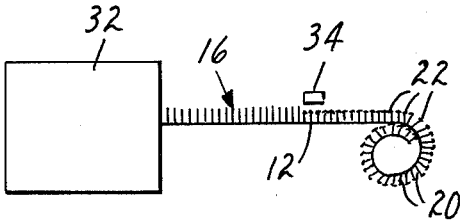
FIG. 6 is a schematic view of a method for forming the strip material of FIG. 1.
Figure 9:
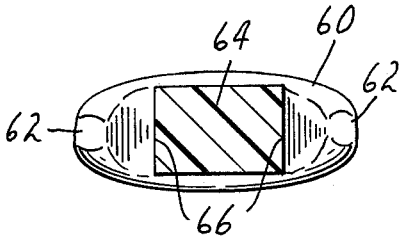
FIG. 9 is a sectional view taken approximately along line 9—9 of FIG. 8.

The method for making the strip material 10 is schematically illustrated in FIG. 6. That method includes forming the backing 12 and the multiplicity of lengths of polymeric monofilament 16, with each length having a bight portion 18 secured in the backing 12, and two stem portions 20 (each of which may be a part of a different loop) extending from the opposite ends of the bight portion 18 and projecting generally normal to an exposed major surface of the backing 12, which forming can be done on a weaving machine 32 generally as is described in U.S. Pat. No. 3,770,359.

The monofilaments 16 are then heated to form the enlarged heads 22. Such heating can be done by a radiant heater 34 spaced from the monofilaments 16, or by a hot wire that intercepts the monofilaments 16, as is well known in the art. The novel feature in the method according to the present invention is to use the monofilaments 16 having cross sections defining the plurality of radially projecting lobes 17 (see FIG. 3), so that the heating step forms from the lobes 17 the hook-like portions 26 included in heads 22, with the hook-like portions 26 spaced from the stem portions 20 and projecting along the stem portions 20 toward the backing 12.

When the end of the monofilament 16 is softened by a heat source (physically or radiantly), the polymer (e.g., polypropylene) of which the monofilament 16 is made begins to flow down each lobe 17, and a head 22 is formed with three separate hook-like portions 26 as is described above.

Figure 7:
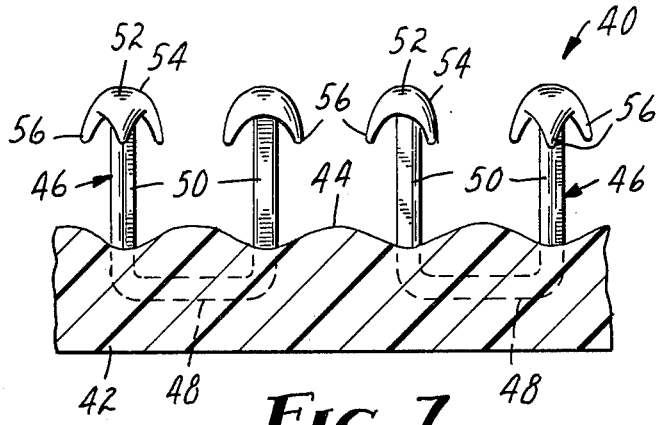
FIG. 7 is a fragmentary sectional view of a second embodiment of the strip material according to the present invention.

FIG. 7 illustrates a second embodiment of an elongate strip material 40 according to the present invention which can be formed by the method described in U.S. Pat. No. 4,290,832, can provide greater versatility in the density and spacing of headed stem portions that may be provided on a backing to vary the holding power of the strip material 40, and may be less expensive to manufacture than the strip material 10, but would have a stiffer backing than the backing 12. The strip material 40 comprises a non-fibrous polymeric backing 42 having an exposed major surface 44, and a multiplicity of flexible resilient lengths of longitudinally oriented polymeric monofilament 46, each length including a central bight portion 48 secured by being embeded and bonded or fused in the backing 42, two straight stem portions 50 extending from the opposite ends of the bight portion 48 and projecting generally normal to the exposed major surface 44 of the backing 42, and an enlarged head 52 at each of the unsupported ends of the stem portions 50. Like the heads 22, each of the heads 52 is formed by heating the end of the trilobal monofilament 46 and has a shape resulting from such heating including a generally hemispherical cam surface 54 opposite its supporting stem portion 50 and three hook-like portions 56 spaced from the stem portions 50 and projecting along the stem portions toward the backing 42.

Figure 8:
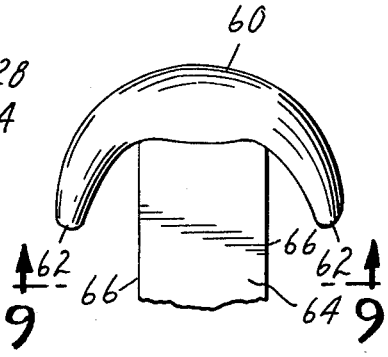
FIG. 8 is a side view of an alternate shape for a head on a stem portion included in the strip material according to the present invention.

While heads 22 or 52 having three hook-like portions 26 or 56 are preferred, heads such as the head 60 illustrated in FIGS. 7 and 8 having two hook-like portions 62 can also be made by the previously described method by starting with monofilaments 64 having two opposite lobes 66 (FIG. 8), and heating the ends of the monofilament 64 as described above.

The present invention has now been described with reference to several embodiments. It will be apparent to those skilled in the art that many changes in and additions to the described embodiments may be made and that the strip material may be used in ways other than those described without departing from the spirit of the invention. For example, four or more lobes may be provided to form heads with four or more hook-like portions, the shape of the lobes may be varied to vary the shape of the hook-like portions for various reasons. Adhesive layers may be provided on the side of the backings opposite the stem portions to facilitate attaching the strip material to a structure. Also by selecting the proper density of and spacing between the stem portions and/or by selecting the shape of the hook-like portions the heads should be capable of engaging each other with a desired degree of engagement so that two lengths of the strip material could be used together to form a fastener.

Thus the claims should not be limited by the descriptions in this specification, but only by the structures and methods steps described by the language of the claims and their equivalents.

I claim:

1. In an elongate strip material which can be severed into lengths to form at least a part of a fastener, said strip material comprising a backing having an exposed major surface; and a multiplicity of flexible resilient lengths of longitudinally oriented polymeric monofilament, each length including a central bight portion secured in said backing, two stem portions extending from the opposite ends of said bight portion and projecting generally normal to said exposed major surface and enlarged heads at the ends of said stem portions opposite said backing adapted to engage loops projecting from a surface closely positioned in opposition to the exposed major surface of the backing, the improvement wherein said lengths of monofilament have a cross section defining a plurality of radially projecting lobes, and said heads include hook-like portions spaced from said stem portions and projecting a distance along said stem portions toward said backing formed by heating the ends of said lengths of monofilament so that each of said lobes forms one of said hook-like portions and loops from a surface closely positioned in opposition to the exposed major surface of the backing will engage under the hook-like portions of said heads and must be broken before separation of the loops and heads can occur in a direction normal to said exposed major surface of the backing.

2. A strip material according to claim 1 wherein said monofilament has a generally equilateral triangular cross-sectional shape defining three of said lobes and said heads have three hook-like portions.

3. A strip material according to claim 1 or claim 2 wherein said backing is a woven structure, and the central bight portions of said lengths of monofilament are woven into said backing.

4. A strip material according to claim 1 or claim 2 wherein said backing comprises a uniform nonfibrous polymeric bonding layer, and the central bight portions of said lengths of monofilament are embedded and bonded in said bonding layer.

* * * * *